US006498435B1

(12) United States Patent
Suzuki

(10) Patent No.: US 6,498,435 B1
(45) Date of Patent: Dec. 24, 2002

(54) CRT DISPLAY DEVICE TO SUPPRESS ELECTROMAGNETIC RADIATION THEREFROM

(75) Inventor: Tomohiko Suzuki, Nishinomiya (JP)

(73) Assignee: Furuno Electric Co., Ltd., Hyogo (JP)

( * ) Notice: Subject to any disclaimer, the term of this patent is extended or adjusted under 35 U.S.C. 154(b) by 0 days.

(21) Appl. No.: 09/807,118

(22) PCT Filed: Aug. 30, 1999

(86) PCT No.: PCT/JP99/04692

§ 371 (c)(1),
(2), (4) Date: Jun. 1, 2001

(87) PCT Pub. No.: WO00/21281

PCT Pub. Date: Apr. 13, 2000

(30) Foreign Application Priority Data

Oct. 7, 1998 (JP) ..... 10-285172

(51) Int. Cl.[7] ..... H01J 1/52

(52) U.S. Cl. ..... 315/85; 315/364; 315/370; 315/368.27; 313/440; 335/214

(58) Field of Search ..... 315/364, 8, 85, 315/370, 382.1, 368.27; 313/440, 413; 335/214

(56) References Cited

U.S. PATENT DOCUMENTS 4,709,220 A * 11/1987 Sakane et al. ..... 335/214
5,317,239 A * 5/1994 Ohguro et al. ..... 315/370
5,675,213 A * 10/1997 Huang et al. ..... 313/440

* cited by examiner

*Primary Examiner*—Don Wong
*Assistant Examiner*—Tuyet T. Vo
(74) *Attorney, Agent, or Firm*—Pillsbury Winthrop LLP

(57) ABSTRACT

To construct a CRT display device capable of effectively suppressing unwanted radiation of electromagnetic waves occurring as a result of horizontal deflection or vertical deflection. A correction lead (6) series-connected to horizontal deflection coils (1) is disposed at outer peripheral positions of the horizontal deflection coils (1) and between the horizontal deflection coils (1) and a faceplate of a CRT (4). With this arrangement, electromagnetic fields produced by the horizontal deflection coils are canceled out by electromagnetic fields produced by the correction lead (6), thereby suppressing unwanted radiation of electromagnetic waves at the deflection frequency and its harmonic components.

16 Claims, 4 Drawing Sheets

CRT DISPLAY DEVICE TO SUPPRESS ELECTROMAGNETIC RADIATION THEREFROM

This application is the national phase of international application PCT/JP99/04692 filed Aug. 30, 1999 which designated the U.S. and that international application was published under PCT Article 21(2) in English.

TECHNICAL FIELD

The present invention relates to a CRT display device capable of suppressing unwanted external radiation of electromagnetic waves.

BACKGROUND ART

For a CRT display device like an electronic apparatus provided with a CRT (cathode ray tube), international standards stipulate upper limits of the intensity of electromagnetic waves radiated to the exterior from the CRT display device. One objective of these standards is to provide a specific level of safety which would prevent causing adverse effects on other nearby electronic apparatus. Thus, for marine electronics apparatuses, for example, of which many units are installed together with other units in a limited space, far more stringent standards are set forth to maintain navigation safety.

In a conventional CRT display device, a metallic shield cover used to be adopted to surround the outer periphery of a unit to suppress unwanted external radiation of electromagnetic waves. A CRT faceplate, however, cannot be covered with a shield cover made of a metal plate, so that a previous practice has been to cover the faceplate with a semitransparent filter covered with evaporated and deposited metal particles.

While a deflection yoke having horizontal deflection coils and vertical deflection coils, leads wires of the horizontal deflection coils and the vertical deflection coils, a high-voltage generating circuit formed by a flyback transformer, for instance, and its leads wires are sources of the aforementioned unwanted radiation, it is possible to effectively suppress the unwanted radiation of electromagnetic waves by making an enclosure of the CRT display device to serve as a shield cover. In addition, if the aforementioned semitransparent filter is provided on the CRT faceplate, unwanted electromagnetic radiation from the CRT faceplate can be suppressed to a certain degree. Unwanted electromagnetic emissions in a high-frequency range of tens to hundreds of megahertz (MHz), for example, can be sufficiently suppressed by this arrangement. However, it has scarcely been possible to suppress unwanted electromagnetic emissions at harmonic frequencies corresponding to several multiples of the horizontal deflection frequency, such as at tens to hundreds of kilohertz (kHz). Moreover, the use of aforementioned semitransparent filter could develop such problems that it would cause a reduction in screen brightness and a cost increase.

It is an object of the invention to provide a CRT display device effectively suppressing unwanted radiation of electromagnetic waves which could occur as a result of horizontal deflection or vertical deflection.

DISCLOSURE OF THE INVENTION

According to this invention, part of a deflection coil of a CRT or a lead wire of the deflection coil is used as a correction lead, and the correction lead is disposed inside an enclosure surrounding the CRT, wherein an electromagnetic field leaking from the CRT to the exterior is suppressed by an electromagnetic field generated by the correction lead. With this construction, an electromagnetic field produced in association with horizontal deflection or vertical deflection is canceled out by the electromagnetic field generated by the aforementioned correction lead and, in particular, electromagnetic fields leaking to the exterior through a faceplate of a CRT display device are suppressed in a reliable fashion.

According also to this invention, the correction lead is attached to a shield case surrounding the CRT at the rear of the CRT faceplate. Since the shield case surrounding the CRT has a fixed relative position relationship with a horizontal deflection coil or with a vertical deflection coil, the relationship between the phase and intensity of the electromagnetic field produced by the deflection coil and those of the electromagnetic field produced by the correction lead is kept unchanged. Furthermore, the invention facilitates positioning of the correction lead in the internal space of the enclosure. In addition, special components for arranging the deflection coil in the internal space of the CRT display device become unnecessary.

According also to this invention, a lead wire connecting a connector for the deflection coil that is connected to a connector on a circuit board on which a deflection drive circuit is provided and the deflection coil is used as the correction lead. With this construction, the correction lead can be provided simply by fitting a deflection yoke to the CRT, placing the lead wire of the deflection coil at specific positions, and connecting the connector at the end of the lead wire to the connector on the circuit board.

According also to this invention, the correction lead is fitted to specific points between the outer periphery of a CRT faceplate and the deflection coil. This construction serves to effectively suppress unwanted radiation from the deflection coil in the direction of the CRT faceplate.

According again to this invention, the correction lead connected to the horizontal deflection coil is placed at specific positions and thereby suppresses the fundamental component of a horizontal deflection frequency and its harmonic components radiated due to horizontal deflection of the CRT.

BEST MODE FOR CARRYING OUT THE INVENTION

Construction of a CRT display device according to an embodiment of this invention is described with reference to FIGS. 1 and 2.

Figure 1:
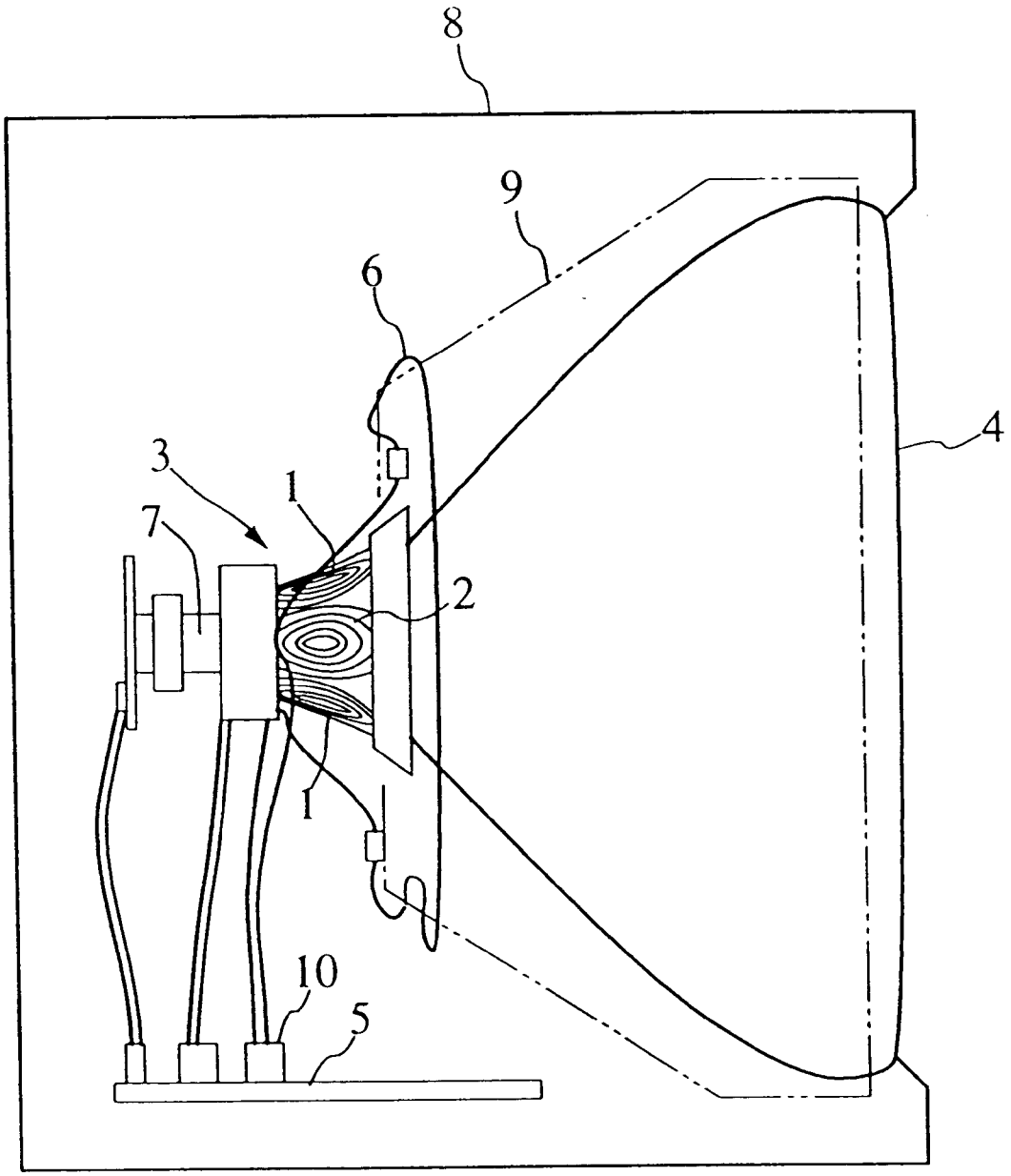
FIG. 1 is a side view showing the internal construction of a CRT display device according to an embodiment of this invention.
Figure 2:
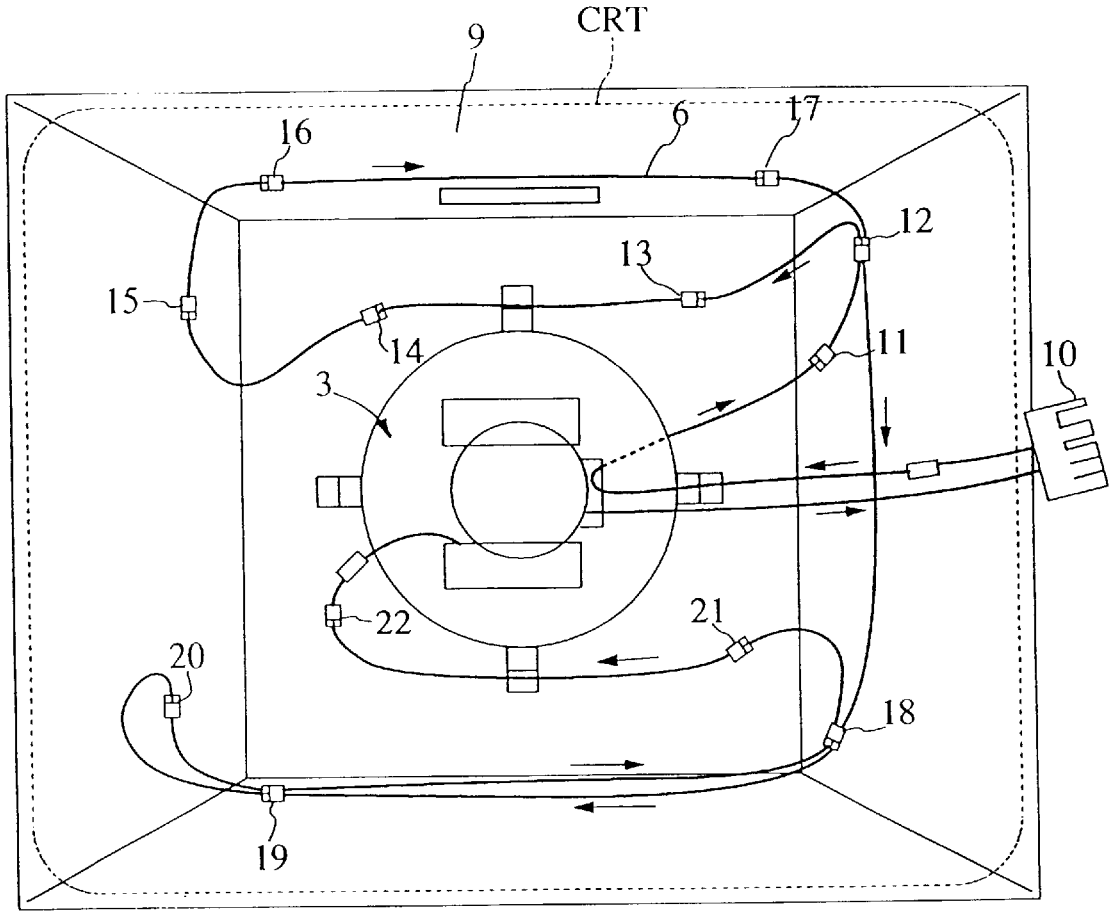
FIG. 2 is a rear view showing the internal construction of the device.

FIG. 1 is a diagram showing the internal construction of the CRT display device as viewed from its one side, and FIG. 2 is a diagram showing the internal construction of the CRT display device as viewed from its rear side. In FIG. 1, designated by the numeral 4 is a CRT with a deflection yoke 3 attached to its neck portion. The deflection yoke 3 is provided with horizontal deflection coils 1 and vertical deflection coils 2. Designated by the numeral 9 is a magnetic shield case made of permalloy, for instance, that surrounds the CRT 4. This shield case 9 prevents the occurrence of mislanding of an electron beam caused by external magnetic fields such as geomagnetism. Designated by the numeral 5 is a circuit board including a deflection drive circuit and a video signal circuit. The deflection drive circuit supplies deflecting currents to the horizontal deflection coils and the vertical deflection coils, whereas the video signal circuit outputs a video signal to a CRT printed circuit which is attached to a rear end of the CRT 4. The CRT printed circuit drives a heater of the CRT and applies a voltage corresponding to the video signal to a cathode. Also provided is a high-voltage generating circuit which applies a high voltage to an anode of the CRT 4 and supplies a focusing voltage to an electron gun 7 and a screen voltage.

Designated by the numeral 6 in FIG. 1 is a correction lead which is series-connected between a lead for a horizontal deflection signal taken out from the circuit board 5 and the horizontal deflection coils 1. Designated by the numeral 8 is a metallic case accommodating all the above components and shielding five sides of the CRT display device, excluding its CRT faceplate, to prevent unwanted radiation of electromagnetic waves therefrom.

Referring to FIG. 2, designated by the numeral 10 is a connector which is connected to a connector for the horizontal deflection signal on the circuit board (the connector to be connected to the connector on the circuit board 5 shown in FIG. 1). A lead wire run from one terminal of this connector 10 is successively fixed by wiring clamps attached to a plurality of specific points of the shield case 9 as shown by arrows. One extreme end of this lead wire is connected to one end of the horizontal deflection coils, and the other end of the horizontal deflection coils is connected to another terminal of this connector 10. The aforementioned wiring clamps 11–22 are attached to the respectively predetermined points.

The lead wire of the horizontal deflection coils is extended as described above and used as the correction lead. With this correction lead disposed at outer peripheral positions of the horizontal deflection coils and at positions in a space between the outer peripheral positions and the CRT faceplate, electromagnetic fields produced by the horizontal deflection coils, in particular, are canceled out by electromagnetic fields produced by the correction lead, so that electromagnetic waves radiated from the CRT faceplate are suppressed.

Figure 3:
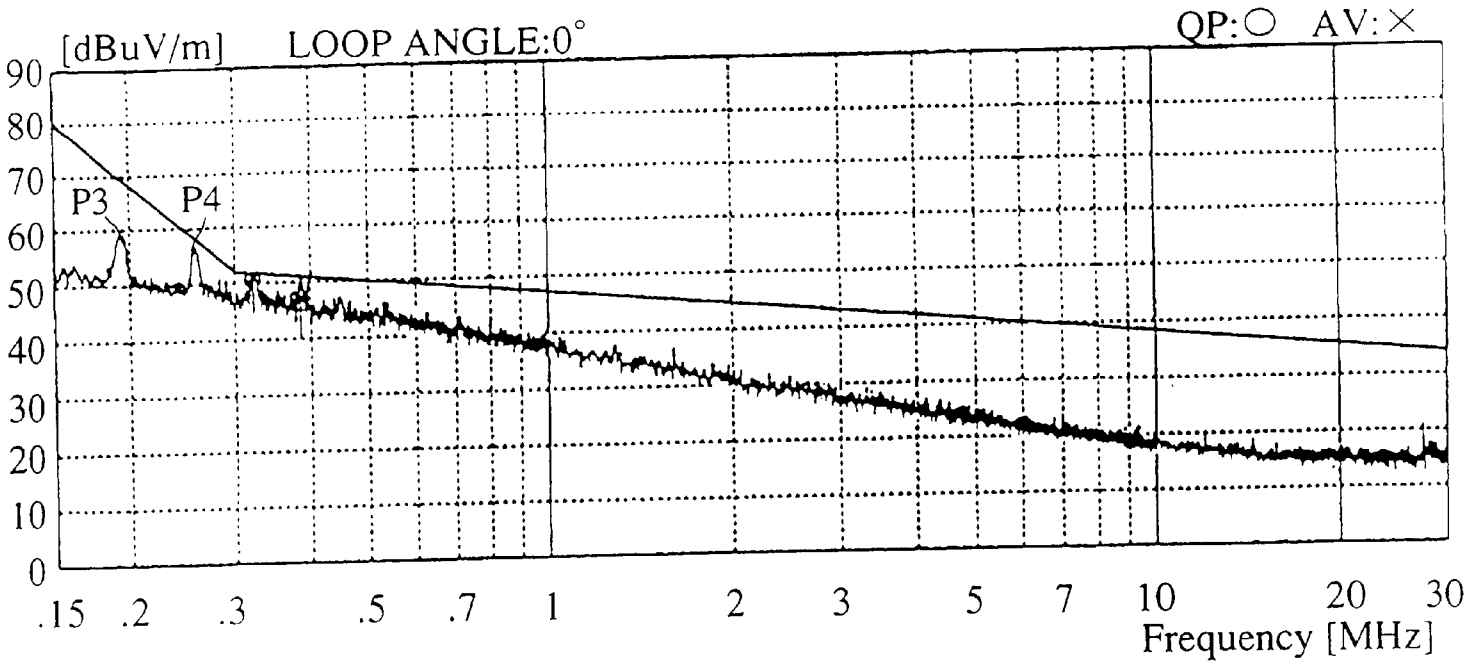
FIG. 3 is a diagram showing measurement results of unwanted emissions from the CRT display device according to an embodiment.
Figure 4:
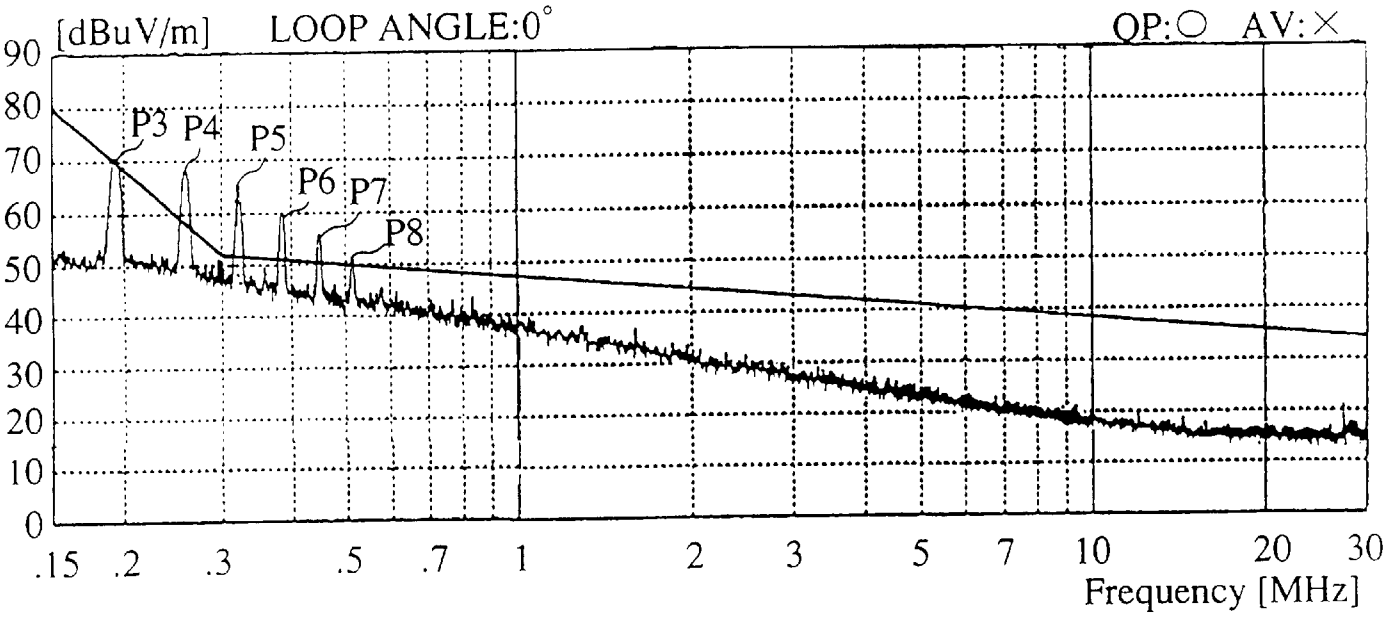
FIG. 4 is a diagram showing measurement results of unwanted emissions from a conventional CRT display device.

FIG. 3 shows a frequency spectrum of electric field strength in a direction perpendicular to the CRT faceplate of the CRT display device according to the aforementioned construction, and FIG. 4 shows a frequency spectrum of electric field strength obtained when the aforementioned correction lead is not provided. In these two figures, curved lines indicate actually measured frequency spectra whereas straight lines indicate maximum permissible levels stipulated in a specific standard, in which the maximum permissible levels are represented by a line passing through the points of an electric field strength 80 dB$\mu$V/m at 0.15 MHz, 52 dB$\mu$V/m at 0.3 MHz and 34 dB$\mu$V/m at 30 MHz. In this standard, greater importance is placed on components equal to and higher than 300 kHz than on components below 300 kHz. In FIG. 4, points P3, P4, P5 and so on are components corresponding to the third harmonic, fourth harmonic, fifth harmonic and so on of a horizontal deflection frequency. From this, it is understood that strong electromagnetic fields are produced particularly in association with horizontal deflection. If the aforementioned correction lead is placed at specific positions, individual harmonic components of the horizontal deflection frequency can be sufficiently suppressed, thereby complying with maximum permissible level requirements. Incidentally, if the direction of electric current flowing through the aforementioned correction lead is reversed, the harmonic components at the points P3, P4, P5 and so on become higher than they are in the case of FIG. 4. It is understood from this that the electromagnetic fields produced by the horizontal deflection coils can be canceled out by the electromagnetic fields produced by the correction lead if the arrangement of the correction lead and the direction of the electric current flowing in it is properly determined.

While the correction lead is arranged chiefly at the outer peripheral positions of the deflection coils in the above-described embodiment, it may be arranged at a different positions. Specifically, since the correction lead serves to suppress leakage of the electromagnetic fields produced mainly by the deflection coils particularly in the direction of the CRT faceplate, what is essential is to place the correction lead at specific positions inside the casing. For example, the correction lead may be placed in a space closer to the CRT faceplate between the deflection coils and the CRT face plate where necessary, or close to an outer peripheral part (outer edge portion) of the CRT faceplate, so that the suppressing effect would be increased. In addition, the length and the number of turns of the correction lead may be adjusted so that the aforementioned suppressing effect would be most apparently observed.

Since the aforementioned correction lead is placed sufficiently apart from the neck portion of the CRT in the direction of the CRT faceplate and in the direction of its outer peripheral part, and the number of turns of the correction lead is sufficiently smaller than that of the deflection coils, the correction lead does not exert any apparent influence on electron beam deflecting effect. (Generally, the number of turns of a horizontal deflection coil is 100 to 200 whereas the number of turns of the correction lead is about one or two.)

While the lead wire of the deflection coils is provided to serve as the correction lead in the aforementioned embodiment, part of the deflection coils may be extended and this extended part may be used as a correction lead.

Furthermore, while the correction lead is connected to the horizontal deflection coils in the embodiment, a correction lead may be connected the vertical deflection coils in a similar way, or part of the vertical deflection coils may be used as a correction lead, in order to suppress unwanted radiation corresponding to vertical deflection frequency components.

According to this invention, electromagnetic fields produced in association with horizontal deflection or vertical deflection are canceled out by the electromagnetic fields produced by the correction lead and, in particular, the electromagnetic fields leaking to the exterior through the faceplate of the CRT display device are suppressed in a reliable fashion.

Furthermore, the invention facilitates positioning of the deflection coils in the internal space of the CRT display device. In addition, since special components for arranging the deflection coils in the internal space of the CRT display device are made unnecessary, almost no costs for the suppression of unwanted radiation are required.

Also, the correction lead can be provided simply by fitting the deflection yoke to the CRT, placing the lead wire of the deflection coils at specific positions, and connecting the connector at the end of the lead wire to the connector on the circuit board.

Moreover, since the fundamental component of electromagnetic waves at the horizontal deflection frequency radiated due to horizontal deflection of the CRT and its harmonic components are suppressed, it is possible to effectively suppress unwanted radiation components at 300 kHz and above.

INDUSTRIAL APPLICABILITY

This invention is applicable to marine electronics equipment and aviation electronics equipment provided with a CRT display device which should not adversely affect other electronic apparatus by electromagnetic waves.

What is claimed is:

1. A CRT display device in which part of a deflection coil of a CRT or a lead wire of the deflection coil is used as a correction lead, and the correction lead is disposed in a space from outer peripheral positions of the deflection coil to a CRT faceplate inside an enclosure surrounding the CRT such that the correction lead generally surrounds a periphery of side surfaces of the CRT, and the CRT display device suppresses a first electromagnetic field leaking from the CRT to an exterior in a direction of the CRT faceplate by a second electromagnetic field generated by the correction lead.

2. The CRT display device according to claim 1, wherein the deflection coil is a horizontal deflection coil, and the second electromagnetic field generated by the correction lead suppresses a fundamental component and harmonic components of a horizontal deflection frequency that radiates from the CRT.

3. The CRT display device according to claim 1, wherein the correction lead is fitted to specific points between an outer periphery of the CRT faceplate and the deflection coil.

4. The CRT display device according to claim 3, wherein the deflection coil is a horizontal deflection coil, and the second electromagnetic field generated by the correction lead suppresses a fundamental component and harmonic components of a horizontal deflection frequency that radiates from the CRT.

5. The CRT display device according to claim 1, wherein the correction lead is a lead wire connecting the deflection coil and a connector, the connector is connected to a circuit board, and a deflector drive circuit is provided on the circuit board.

6. The CRT display device according to claim 5, wherein the correction lead is fitted to specific points between an outer periphery of the CRT faceplate and the deflection coil.

7. The CRT display device according to claim 3, wherein the deflection coil is a horizontal deflection coil, and the second electromagnetic field generated by the correction lead suppresses a fundamental component and harmonic components of a horizontal deflection frequency that radiates from the CRT.

8. The CRT display device according to claim 6, wherein the deflection coil is a horizontal deflection coil, and the second electromagnetic field generated by the correction lead suppresses a fundamental component and harmonic components of a horizontal deflection frequency that radiates from the CRT.

9. The CRT display device according to claim 1, wherein the correction lead is attached to a shield case surrounding the CRT.

10. The CRT display device according to claim 9, wherein the deflection coil is a horizontal deflection coil, and the second electromagnetic field generated by the correction lead suppresses a fundamental component and harmonic components of a horizontal deflection frequency that radiates from the CRT.

11. The CRT display device according to claim 9, wherein the correction lead is fitted to specific points between an outer periphery of the CRT faceplate and the deflection coil.

12. The CRT display device according to claim 11, wherein the deflection coil is a horizontal deflection coil, and the second electromagnetic field generated by the correction lead suppresses a fundamental component and harmonic components of a horizontal deflection frequency that radiates from the CRT.

13. The CRT display device according to claim 9, wherein the correction lead is a lead wire connecting the deflection coil and a connector, the connector is connected to a circuit board, and a deflector drive circuit is provided on the circuit board.

14. The CRT display device according to claim 13, wherein the deflection coil is a horizontal deflection coil, and the second electromagnetic field generated by the correction lead suppresses a fundamental component and harmonic components of a horizontal deflection frequency that radiates from the CRT.

15. The CRT display device according to claim 13, wherein the correction lead is fitted to specific points between an outer periphery of the CRT faceplate and the deflection coil.

16. The CRT display device according to claim 15, wherein the deflection coil is a horizontal deflection coil, and the second electromagnetic field generated by the correction lead suppresses a fundamental component and harmonic components of a horizontal deflection frequency that radiates from the CRT.

* * * * *